US007454799B2

(12) United States Patent
Wuensche et al.

(10) Patent No.: US 7,454,799 B2
(45) Date of Patent: Nov. 25, 2008

(54) HAT FOR ACCOMMODATING HAIR AND METHOD

(76) Inventors: Chris Wuensche, 1305 Rosewood Trail, Flower Mound, TX (US) 75028; Grace Wuensche, 1305 Rosewood Trail, Flower Mound, TX (US) 75028

( * ) Notice: Subject to any disclaimer, the term of this patent is extended or adjusted under 35 U.S.C. 154(b) by 174 days.

(21) Appl. No.: 11/192,495

(22) Filed: Jul. 29, 2005

(65) Prior Publication Data

US 2007/0022516 A1 Feb. 1, 2007

(51) Int. Cl.
*A42B 1/00* (2006.01)

(52) U.S. Cl. ..... 2/172; 2/209.7; 2/209.3; 2/171; 2/195.1

(58) Field of Classification Search ..... 2/172, 2/209.7, 209.3, 171, 195.1
See application file for complete search history.

(56) References Cited

U.S. PATENT DOCUMENTS

| | | | | | |
|---|---|---|---|---|---|
| 3,065 | A | | 5/1843 | Dennis, Jr. | |
| 2,416,062 | A | | 2/1947 | Mercer | |
| 3,430,266 | A | * | 3/1969 | Andrian | 2/200.1 |
| 4,439,871 | A | * | 4/1984 | Plastino | 2/422 |
| 5,321,854 | A | | 6/1994 | Kronenberger | |
| D350,427 | S | * | 9/1994 | Vig et al. | D2/887 |
| 5,487,191 | A | * | 1/1996 | Ridley | 2/195.1 |
| 5,495,622 | A | * | 3/1996 | Kaufman | 2/175.1 |
| 5,509,145 | A | | 4/1996 | Stevenson et al. | |
| 5,511,249 | A | | 4/1996 | Higgins | |
| 5,598,585 | A | | 2/1997 | Stroup | |
| 5,644,799 | A | | 7/1997 | Armenta et al. | |
| D386,888 | S | * | 12/1997 | Grant | D2/865 |
| 5,799,334 | A | | 9/1998 | Griffeth et al. | |
| 5,839,121 | A | * | 11/1998 | Morales | 2/7 |
| D402,414 | S | | 12/1998 | Smith | |
| 5,855,023 | A | * | 1/1999 | Clingenpeel et al. | 2/7 |
| D405,590 | S | | 2/1999 | Bartz | |
| D406,189 | S | | 3/1999 | Hosogai | |
| 5,875,488 | A | | 3/1999 | Milani | |
| 5,875,494 | A | | 3/1999 | Garnier, Jr. et al. | |
| 5,907,871 | A | * | 6/1999 | Austin | 2/209.12 |
| 5,933,872 | A | | 8/1999 | Lema | |
| D424,282 | S | | 5/2000 | Crumpton et al. | |
| 6,240,566 | B1 | | 6/2001 | Scantlin | |
| 7,082,618 | B1 | * | 8/2006 | Muso | 2/175.1 |
| 2002/0162155 | A1 | | 11/2002 | Griffin | |

(Continued)

OTHER PUBLICATIONS

Webpage from http://girl32.com/index.php?,page=how_to, printed May 12, 2005, p. 1.
Webpage from http://getahaton.com/proddetail.php?prod=D152&cat=16, printed May 12, 2005, pp. 1-2.

*Primary Examiner*—Gary L Welch
*Assistant Examiner*—Alissa J Tompkins
(74) *Attorney, Agent, or Firm*—Grady K. Bergen; Griggs Bergen LLP

(57) ABSTRACT

A method of wearing a hat is accomplished by providing a hat with a crown and a brim projecting from the crown. A hole is provided in a sidewall of the crown and a hole in the brim. The hat is positioned on a wearer's head and the hair of the wearer is passed through at least one of the holes of the crown or brim. A hat is also disclosed having a crown with a sidewall that defines a central opening for receiving a wearer's head. A brim projects from the crown. The brim has a hole configured for allowing passage of the wearer's hair therethrough.

20 Claims, 3 Drawing Sheets

U.S. PATENT DOCUMENTS

2002/0162157 A1 11/2002 Hoyez
2004/0006809 A1 1/2004 Crenshaw et al.
2004/0128740 A1 7/2004 Hoyez
2004/0210983 A1 10/2004 Early
2005/0066421 A1 3/2005 Brundage
2006/0010566 A1* 1/2006 Ridgeway ..... 2/171

* cited by examiner

HAT FOR ACCOMMODATING HAIR AND METHOD

TECHNICAL FIELD

The invention relates generally to hats and headwear.

BRIEF DESCRIPTION OF THE DRAWINGS

For a more complete understanding of the present invention, reference is now made to the following descriptions taken in conjunction with the accompanying figures, in which.

DETAILED DESCRIPTION

Figure 1:
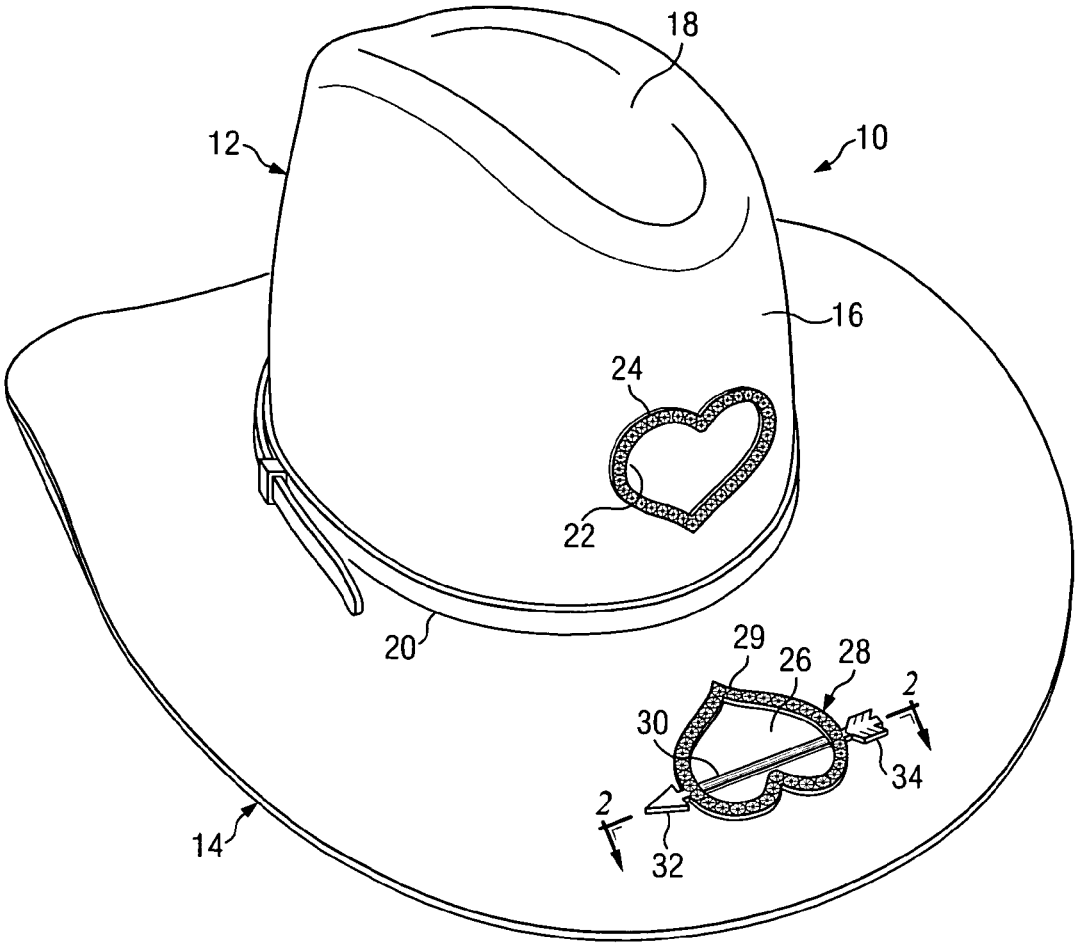
FIG. 1 is a rear perspective view of a hat constructed in accordance with the invention.

Referring to FIG. 1, a hat 10 having a crown 12 and a brim 14, which surrounds all or a portion of the crown 12, is shown. The hat 10 may be of various configurations and styles and may be formed from a variety of materials such as those that may be common to the construction of hats or headwear (egs. straw, felt, fabric, leather, plastic, etc.). In the embodiment shown, the hat 10 has a cowboy-style configuration.

The crown 12 may have a circumferential sidewall 16 that defines a lower central opening for receiving the head of a wearer. The upper end or peak of the crown 12 may be closed with a top portion or wall 18 or the peak may be open.

The brim 14 may be joined at its innermost edge to the lower edge or portion of the crown sidewall 16. An optional hat band 20 may be provided with the hat 10 and may circumferentially extend around the lower portion of the crown 12, as is shown. In the embodiment shown, the brim 14 extends circumferentially around the entire crown 12 and projects generally radially outward from the lower edge of the crown 12. It should be apparent to those skilled in the art, however, that the brim 14 may extend around all or only a portion of the crown 12.

Formed in the sidewall 16 of the crown 12 is an opening or hole 22. The hole 22 may be located at the rear or back portion of the crown 12, but may be located at different locations as well. The hole 22 may be located at a position on the crown sidewall 16 so that a gathering of the wearer's hair, such as a pony tail, may be readily passed through the hole 22 from the interior of the crown to the exterior, while the hat 10 is being worn on the wearer's head. This may include the hole 22 being located near or slightly above the lower edge of the crown sidewall 16. The hole 22 may be bounded on all sides by portions of the crown sidewall.

The hole 22 may be of various sizes to facilitate the passage of the wearer's hair. This may include a hole having a cross dimension of approximately 1", 1½", 2", 2½" or more. The hole 22 may also be configured in various shapes, which may include circular and oval shapes, as well as non-circular or non-oval shapes. The shape of the hole 22 may be decorative or thematic in nature and may depict various recognizable objects. In the embodiment of FIG. 1, the hole 22 is shown as being in a heart shape.

A border piece 24 is provided with the hole 22. The border piece 24 may be secured to and cover all or a portion of the edges of the hole 22 to provide a finished or decorative appearance. The border piece 24 may be formed from a variety of materials, such as metal, plastic, wood, leather, etc. In particular, decorative metals, such as silver, gold, copper, bronze, brass, etc. may be used for the border piece 24. Additionally, the border piece may be sculptured, jeweled, carved, textured or otherwise be provided with a decorative appearance. In the embodiment shown, the border piece 24 is in the shape of heart to correspond to the heart-shaped hole 22. The border piece 24 may be secured to the hole by the use of fasteners, adhesive, crimping, stitching or other fastening means well known to those skilled in the art.

An opening or hole 26 is also formed in the brim 14 of the hat 10. The hole 26 may be spaced between the inner and outer edges of the brim 14 and may be bounded on all sides by portions of the brim 14. The hole 26 may be similar in size and configuration to the hole 22 of the crown 12. As shown, the hole 26 is located on the back or rear portion of the brim 14 and may be generally aligned with the hole 22, as shown, to facilitate the passage of hair from the interior of the crown 12 through the hole 22 and to the hole 26. In the particular embodiment shown, the hole 26 is also configured in a heart shape.

A border piece 28 may also be provided with the hole 26 of the brim 14. The border piece 28 may be similar to the border piece 24, previously described, including a heart-shaped body 29. In the embodiment shown, the border piece 28 includes a hair band 30, which extends transversely across the width of the hole 26. The hair band 30 may be of an elastic material so that it may be stretched to facilitate positioning of hair beneath the band 30. The band 30 may be secured at either end to opposite sides of the border piece 28.

In the embodiment shown, the heart-shaped border piece 28 is configured to appear as if it has an arrow, such as those used in archery, passing through the heart-shaped body 29. To accomplish this, opposite arrow head and fletching end portions 32, 34 may be provided with the border piece 28. The hair band 30 may be oriented and sized to approximate a shaft of the arrow, terminating with the arrow end portions 32, 34.

Figure 2:
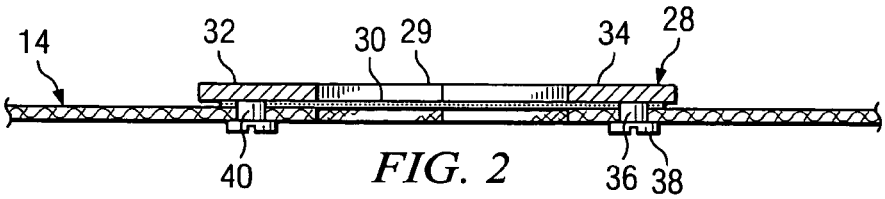
FIG. 2 is cross-sectional view of a portion of the hat of FIG. 1 taken along the lines II-II.

Referring to FIG. 2, the end portions 32, 34 also may be used to secure the border piece 28 to the brim 14 of the hat 10. Each of the end portions 32, 34 may carry a fastener. In the embodiment shown, the fastener may be a Chicago-type screw wherein a screw post 36 is joined to the end portions 32, 34 and projects from the underside of the end portion through small holes or apertures formed in the brim 14. A mating screw 38 engages the screw post 36 to secure the end portions 32, 34 to the brim 14. The ends of the hair band 30 may be provided with loops 40 that may be secured to the screw post 36 to facilitate securing of the hair band 30 to the border piece 28.

Figure 3:
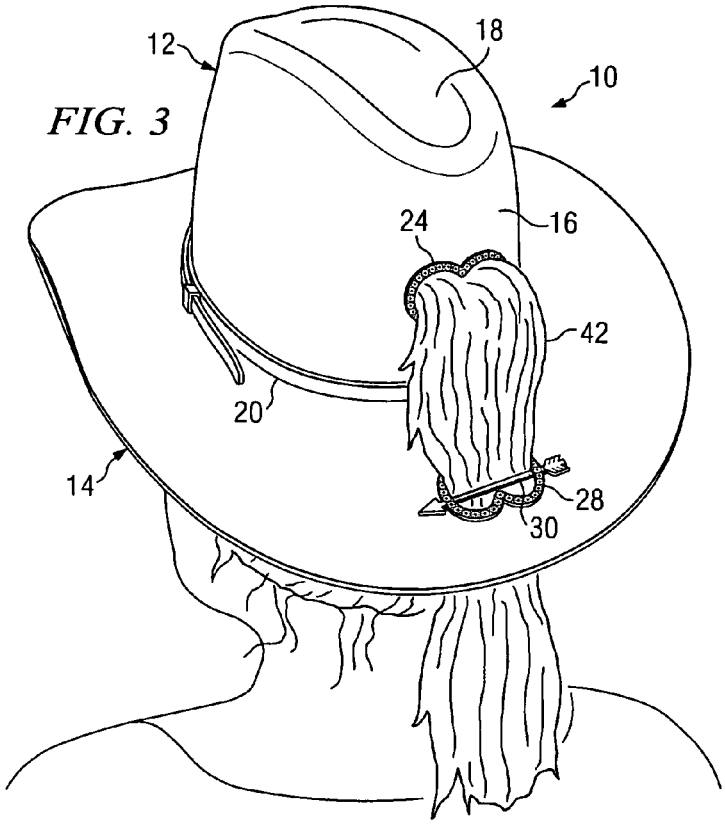
FIG. 3 is a rear perspective view of the hat of FIG. 1, shown with hair of a wearer being passed through holes of the hat in accordance with the invention.

In use, as shown in FIG. 3, a wearer may pass a gathering or collection 42 of their hair from the interior of the crown 12 through the opening 22. If the hair is of sufficient length, the gathering 42 may be further passed downward through the opening 26 of the brim 14. The hair 42 may be positioned beneath the hair band 30 to facilitate holding the hair within the opening 26.

The openings 22 and 26 allow the hat 10 to accommodate large gatherings of hair that may otherwise be collected within the crown itself when the hat is worn on the wearer's head. This may make wearing of the hat uncomfortable to the wearer or require that a hat with a larger crown be used to accommodate the collection of hair. The passing of the wearer's hair through the openings may also facilitate holding of the hat 10 in place upon the wearer's head. This may be particularly beneficial during activities where the hat 10 may be prone to being displaced from the wearer's head. If desired, non-hair items may be passed through the openings 22, 26, such as ribbons, streamers, etc.

Figure 4:
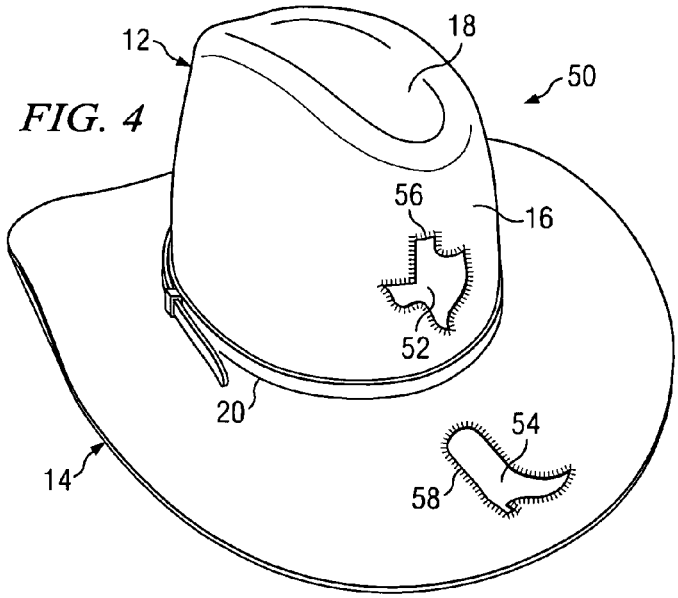
FIG. 4 is a rear perspective view of another embodiment of a hat constructed in accordance with the invention.

Referring to FIG. 4, another embodiment of a hat 50 is shown. The hat 50 is similar in construction to the hat 10, previously described, with similar elements being designated with the same reference numerals. The hat 50 is provided with an opening 52 formed in the crown 12, which may similarly located as the opening 22. Additionally, an opening 54 is provided in the brim 14 of the hat 50, which may be similarly located as the opening 26.

As is shown, the openings 52 and 54 are dissimilar in shape. The hole 52 has the configuration of the state of Texas, whereas the hole 54 is configured in the shape of a cowboy boot. Both openings 52 and 54 are each provided with an embroidered bordering 56, 58, respectively. Additionally, no hair band or other device is provided with the opening of the brim.

In use, the hat 50 may be worn in manner similar to the hat 10, previously described. The wearer's hair may be passed through one or both the openings 52 and 54 in a manner similar to that shown for the hat of FIG. 3.

Figure 5:
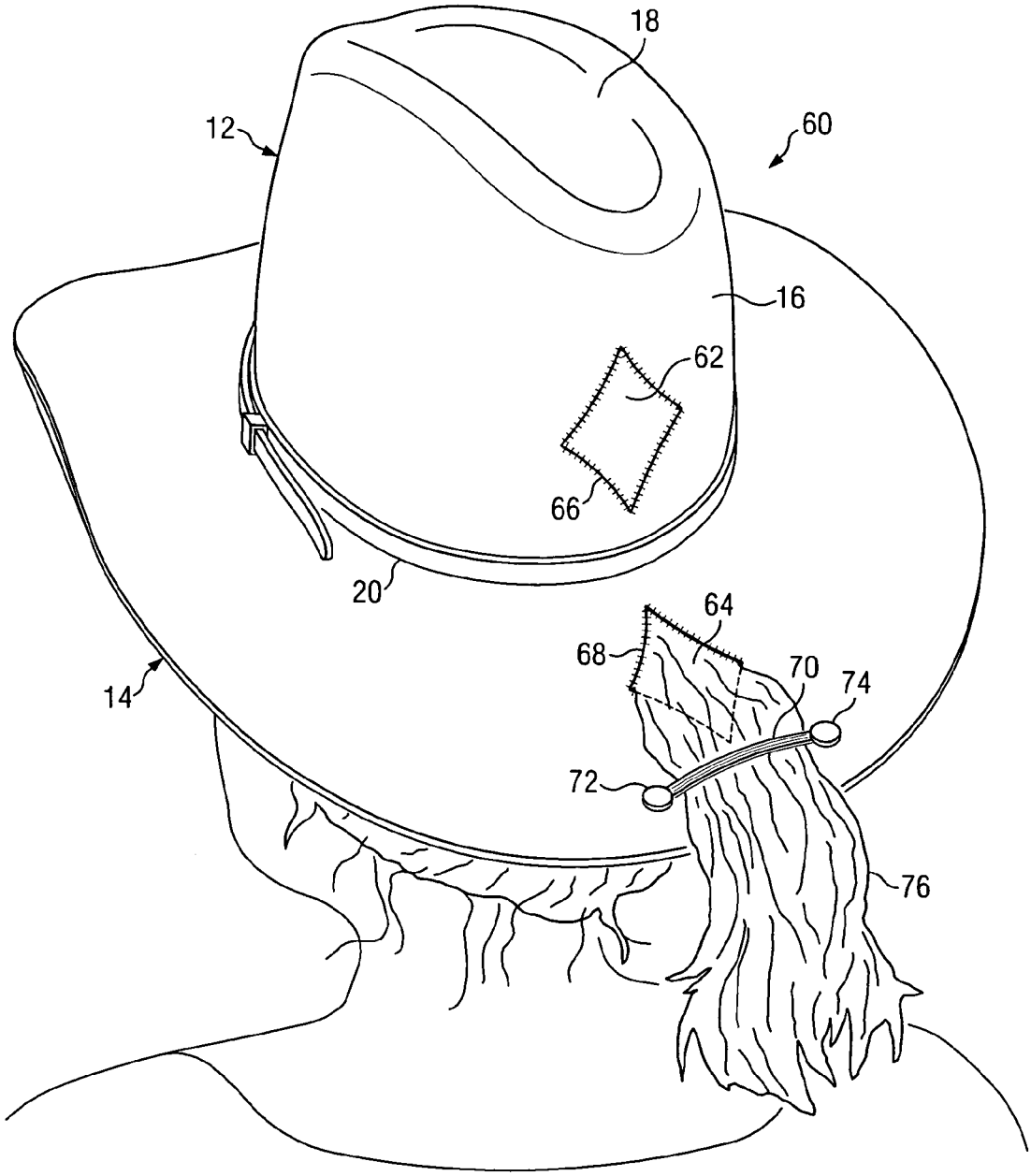
FIG. 5 is side perspective view of still another embodiment of a hat constructed in accordance with the invention.

FIG. 5 shows still another embodiment of a hat 60. The hat 60 is similar in construction to the hats 10 and 50, previously described, with similar elements being designated with the same reference numeral. The hat 60 is provided with openings 62, 64 in the crown 12 and brim 14, respectively. The openings 62, 64 are configured in diamond shapes and are each provided with an embroidered bordering 66, 68.

The hat 60 is also provided with an elastic band 70. The band 70 is positioned adjacent to the opening 64 of the brim 14 in the area between the opening 64 and the outer edge of the brim 14. The ends of the elastic band 70 are secured to the brim 14 by fasteners or other fastening means, such as the Chicago-type screw fasteners 72, 74. It should be noted that an elastic band, such as the band 70 may be positioned adjacent to either openings or holes of the crown or brim and on either side of such holes and should not necessarily be limited to the positions shown.

The hat 60 may be worn in a manner similar to that previously described for the hats 10 and 50. FIG. 5 shows the hat 60 being worn with a gathering 76 of the wearer's hair being passed solely through the hole 64 of the brim 14 so that the hair passes upward from bottom of the brim 14 and out the top, as shown. The gathering 76 is further secured under the elastic band 70.

As can be seen, the hats of the invention can have various configurations and can be worn in a variety of different manners with the wearer's hair being passed through one or both openings of the crown or brim. The wearer's hair can also be conveniently secured beneath a hair band to facilitate holding of the wearer's hair thereunder. Additionally, the hat may be worn without passing of the wearer's hair through the openings in a conventional manner.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. A method of wearing a hat comprising:

providing a hat with a crown and a brim projecting from the crown;

providing a hole in a sidewall of the crown and a hole in the brim;

positioning the hat on a wearer's head; and passing a gathering of hair of the wearer through at least one of the holes of the crown or brim; and wherein the hole of the crown is configured to allow passage of the hair from the interior of the crown to the exterior of the crown to a position outside of the hat; and wherein the holes of the crown and brim have a cross dimension of at least 1½ inches to facilitate the passage of the gathering of hair through said holes.

2. The method of claim 1, wherein:

the wearer's hair is passed through both of the holes in the crown and brim.

3. The method of claim 1, further comprising:

providing a hair band with at least one of the holes to facilitate securing of the wearer's hair.

4. The method of claim 3, wherein:

the hair band extends across said at least one hole.

5. The method of claim 3, wherein:

the hair band is adjacent to the at least one hole.

6. The method of claim 1, wherein:

each of the holes has a decorative or thematic shape.

7. The method of claim 1, wherein:

the wearer's hair is passed through the hole of the brim.

8. The method of claim 1, wherein:

the hole has a non-circular and non-oval shape.

9. The method of claim 1, wherein:

the wearer's hair is passed through the hole of the crown.

10. A hat comprising:

a crown having a sidewall that defines a central opening for receiving a wearer's head, the sidewall of the crown having a hole configured for allowing passage of a gathering of the wearer's hair through the sidewall from the interior of the crown to the exterior of the crown to a position outside of the hat; and a brim projecting from the crown, the brim having a hole configured for allowing passage of the wearer's hair therethrough; and wherein the holes of the crown and brim have a cross dimension of at least 1½ inches to facilitate the passage of the gathering of hair through said holes.

11. The hat of claim 10, wherein:

the hole of the crown is located at the rear of the crown.

12. The hat of claim 10, wherein:

a border piece is secured to the brim to cover the edges of the hole of the brim.

13. The hat of claim 10, wherein:

the hole of the brim has a non-circular and non-oval shape.

14. The hat of claim 10, wherein:

the hole of the brim has a decorative or thematic shape.

15. The hat of claim 10, wherein:

the edges of the hole are provided with embroidering.

16. A hat comprising:

a crown having a sidewall that defines a central opening for receiving a wearer's head, the sidewall of the crown having a hole configured for allowing passage of the wearer's hair through the sidewall from the interior of the crown to the exterior of the crown to a position outside of the hat; and a brim projecting from the crown, the brim having a hole configured for allowing passage of the wearer's hair therethrough; and a hair band provided with at least one of the holes to facilitate securing of the wearer's hair.

17. The hat of claim 16, wherein:

the hair band is coupled to the brim to facilitate securing of the wearer's hair.

18. The hat of claim 16, wherein:

the hair band extends across the hole of the brim.

19. The hat of claim 16, wherein:

the hair band is adjacent to the hole of the brim.

20. The hat of claim 16, further comprising:

a border piece secured to the brim to cover the edges of the hole of the brim; and wherein the hair band is included with the border piece to facilitate securing of the wearer's hair.

* * * * *